United States Patent [19]

Sahrbacker

[11] 3,971,906

[45] July 27, 1976

[54] TRIGGER-LOCK CONTROL

[75] Inventor: Edward V. Sahrbacker, Brecksville, Ohio

[73] Assignee: Lucerne Products, Inc., Hudson, Ohio

[22] Filed: Nov. 1, 1974

[21] Appl. No.: 520,016

[52] U.S. Cl. ..... 200/157; 200/321

[51] Int. Cl.[2] ..... H01H 3/20

[58] Field of Search ..... 200/157, 321, 322, 323, 200/324, 325, 328, 320

[56] References Cited

UNITED STATES PATENTS

| | | | |
|---|---|---|---|
| 3,329,842 | 7/1967 | Brown | 310/50 X |
| 3,383,943 | 5/1968 | Piber | 200/157 X |
| 3,536,973 | 10/1970 | Matthews et al. | 200/157 X |
| 3,873,796 | 3/1975 | Worobec | 200/320 |

*Primary Examiner*—Gene Z. Rubinson
*Assistant Examiner*—M. Ginsburg
*Attorney, Agent, or Firm*—Baldwin, Egan, Walling & Fetzer

[57] ABSTRACT

A trigger-lock control for a motor switch of a power tool is presented including a trigger attached to a rigidly connected elongated slide portion which reciprocates in a housing containing switch components arranged longitudinally in a "power-on" and "power-off" arrangement so that the slide portion can selectively operate these contacts when it is reciprocated by motion of the trigger. A spring urges the trigger and slide portion normally to a power-off position and locking means is provided to lock the elongated slide portion in the power-off position by providing an oscillating lever having a downwardly extending point at its free end which enters into an upwardly opening recess in the upper wall of the slide portion when the parts are in the power-off position. The lever is pivoted on a horizontal pivot on the top of the housing and joined to the lever is either a thumb piece or a lever adapted to be easily operated by a hand of the operator holding the tool.

4 Claims, 2 Drawing Figures

TRIGGER-LOCK CONTROL

Figure 1:
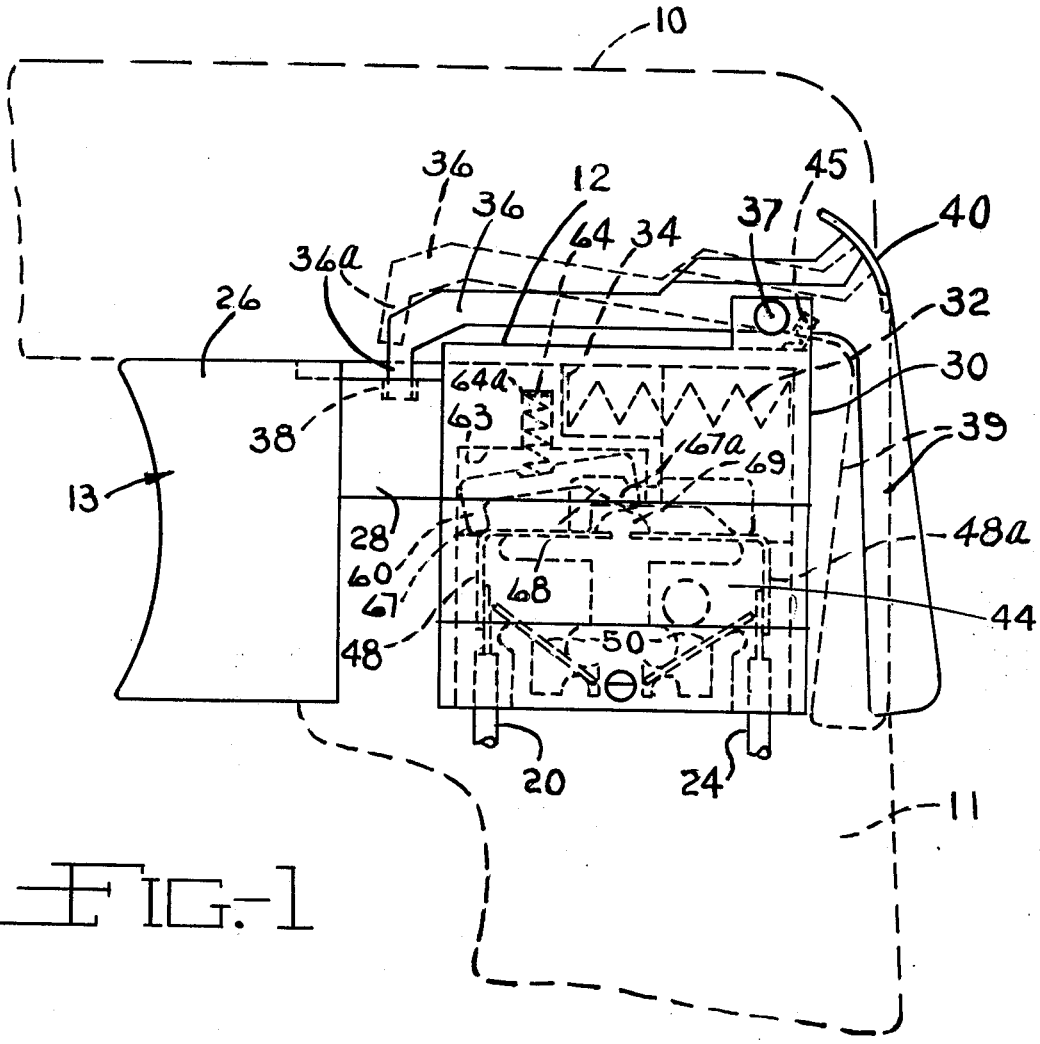

Hand-held electrical power tools are commonly in use today wherein an electrical motor is provided inside the tool structure with a control for the motor manually operated by a trigger at the front end of a slide portion which is reciprocated into and out of a housing control by a finger of the operator resting on the trigger when the operator's hand is grasping the downwardly projecting rear end of the tool. It is desirable that the trigger and slide portion should not be accidentally moved when the tool is not in use and it is an object of the present invention to provide such a tool control for locking the trigger and slide assembly against accidental movement, the same being so arranged that it is easily manipulated into and out of control-locking position by the hand of the operator grasping the tool. A preferred form of the control locks the same in the power-off position, although it will be understood that the same sort of control might be modified to lock the tool in the power-on position in cases where lengthy operation of the tool is utilized on a repetitive job.

Other objects and advantages of this invention will be apparent from the description and the drawings and the essential features thereof will be set forth in the appended claims. One such advantage is to lock the trigger and slide portion in power-off position.

Figure 2:
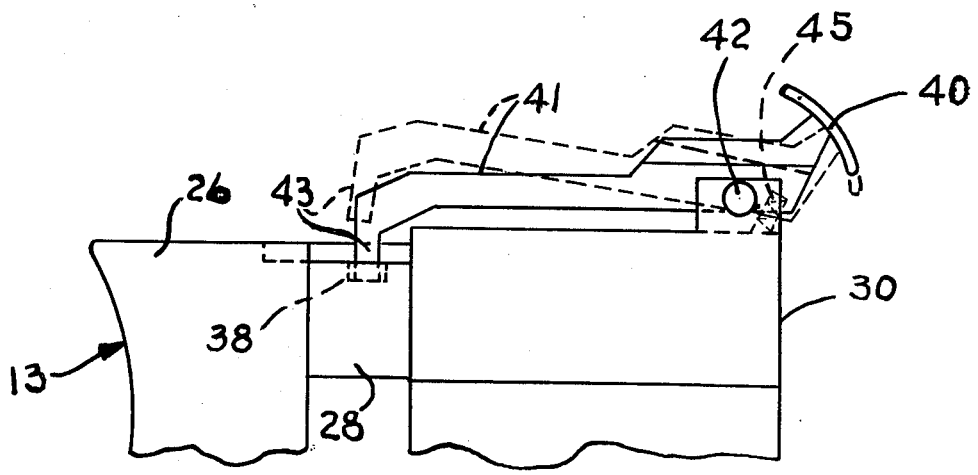

In the drawings,

FIG. 1 shows the control end of a power tool equipped with the new invention and wherein the actuator for the locking means comprises a lever generally parallel to the control housing and in a position to be squeezed toward the housing by a hand grasping the tool; while FIG. 2 is a similar fragmental view of the same control structure wherein the actuator for the locking means has a thumb-engageable member.

It should be understood that this invention may be utilized with any power tool, trigger-controlled assembly wherein reciprocation of the slide portion of the trigger-slide assembly moves the electrical power control contacts between a "power-on" and "power-off" position. The present invention has been described as applied to a switch and speed control like that described and claimed in U.S. Pat. No. 3,536,973, granted Oct. 27, 1970 to Benjamin H. Matthews et al, the said Matthews patent being incorporated herein by reference.

The parts of the said Matthews control necessary for understanding the present invention are described herein and given the same reference numbers as appear in FIG. 7 of the above mentioned Matthews et al patent. The rear portion of a power tool 10 is shown as being of a portable type which includes a depending pistol-grip-like handle 11 as shown in broken lines in FIG. 1. A trigger-switch assembly 12 is mounted in the tool housing and is adapted by electric power supplied at 20 and 24 to control the operation of an electric motor (not shown) powering the tool.

The trigger 13 of the trigger-switch assembly comprises a head portion 26 and an elongated slide portion 28 extending rigidly with and rearwardly from the head portion and received reciprocatingly in a housing 30 which encloses the switch components. A spring 32 coacting between the rear wall of the housing and the recess 34 in the slide portion urges the trigger outwardly of the housing, toward the left in FIG. 1, to a "power-off" position. The slide portion has an abutment (not shown) which limits the outward movement of the trigger with respect to the housing.

A switch case 44 is provided in the housing 30, both of these parts made of electrically insulating material. Mounted along the upper portion of the switch case are a pair of stationary electrically conducting contacts 48 and 48*a*. The stationary contact 48 is adapted for engagement with the electrical power line 20 connected to one side of the tool motor while stationary contact 48*a* is adapted for connection to the electric power line 24. A clip or spring 50 may be provided to give positive engagement of the bare wires of lines 20 and 24 with respective stationary contact member. Associated with the stationary contacts is a bridging contact member 60 which comprises an elongated body portion of electrical conducting material which is received in an associated slot 63 formed in the side of the slide portion 28. In the portion 28, there is also provided a recess 64 communicating with a slot 63 and receiving therein a spring 64*a* which engages a notch in the associated bridging contact member 60 to urge the contact member downwardly. At opposite ends of the contact member 60, there are foot portions 67, 67*a*, with foot portion 67*a* having a sloped camming surface 68 engaging an electrically non-conducting abutment 69 extending upwardly from the associated portion of the switch case 44, for maintaining the bridging contact in an upwardly swung position with respect to the underlying stationary contact 48*a* when the trigger is in the "off" position as shown in FIG. 1. Inward movement of the trigger 13, toward the right in FIG. 1, causes the bridging contact member 60 to be moved rearwardly with the trigger, inwardly of the housing 30, causing the bridging contact to slide along the respective stationary contact members and, under the urging of spring 64*a*, to be moved generally simultaneously downwardly into engagement with the underlying contact 48*a*, while the other foot portion 67 remains in contact with the stationary contact member 48. This places the switch in the "on" condition as shown in dot-dash lines in FIG. 1. Outward movement of the trigger 13 and slide 28, toward the left in FIG. 1, carries the bridging contact member 60 in the same direction, all under the urging of spring 32, which causes the associated projection 69 on the switch case to engage the cam surface 68 on the bridging contact so as to swing its rear foot contact face upwardly out of engagement with the underlying stationary contact 48*a*, returning the switch to the "off" position as shown in broken lines in FIG. 1.

The lock control of this invention is shown as one embodiment in FIG. 1. The oscillatable lock means comprises an arm 36 having a downwardly extending projection 36*a* at the free end of the lever 36. This lever is mounted on top of the housing 30 by means of a pivot 37 which is horizontal when the tool is in working position. In FIG. 1, the projection 36*a* fits into an upwardly opening recess 38 in the elongated slide portion 28 when the trigger assembly is in the "off" position. It is obvious that if it were so desired a recess similar to 38 could be provided to the left of that recess shown in FIG. 1 so that when the trigger assembly was in the "on" position, the combination could be locked in that position if necessary. In FIG. 1, the actuating member for the locking device comprises a lever 39 rigid with the arm 36 and extending downwardly back of the pivot 37 and generally parallel to the rear edge of the housing 30 and in a position to be squeezed toward the housing by a hand grasping the tool. The device might also carry a thumb piece 40 near the junction of the lever 39 and the arm 36 as indicated in FIG. 1. In operating this form of the device, the operator grasps the tool with his thumb and forefinger on opposite sides of the lever 39 and upon squeezing of the lever 39 into the broken line position of FIG. 1, the lock is released at 36*a* – 38 and the operator may then actuate the trigger 13 by means of the forefinger of his hand.

In the form shown in FIG. 2, the parts 26, 28 and 30 and all of the switch components described in FIG. 1 are the same as those previously described. Here the locking device includes an arm 41 oscillatable about horizontal pivot 42 on top of the housing 30 to move a downwardly extending projection 43 at the end of arm 41 into upwardly opening recess 38 as shown in full lines in FIG. 2 or by oscillating the lever 41 in a clockwise direction to the dotted position of FIG. 2, the projection 43 may be lifted out of the locking recess 38. For this purpose a thumb piece 40 is provided rigid with the rear end of lever 41 on the right-hand side of the pivot 42 as seen in FIG. 2 and the operation is very simple inasmuch as the operator can move the thumb piece 40 to lift the arm 41 and release the locking means 38, 43, after which the forefinger of the operator's hand may operate the trigger 13 as desired. In both FIG. 1 and FIG. 2, the lever 36 or 41 is moved toward the locking position shown in full lines by a compression spring 45 working in a counterclockwise direction with respect to the pivot pin 37 or 42.

What is claimed is:

1. A lock control in combination with a trigger-actuated motor control switch for a power tool, comprising a trigger and a rigidly connected elongated slide portion, a housing for switch components, said slide portion reciprocatably mounted in said housing, said switch components in said housing including separated electrical power-on and power-off contacts longitudinally aligned along said slide portion, means operatively connected with said slide portion for moving horizontally between said contacts for changing connection with said contacts upon reciprocation of said slide portion, spring means urging said trigger and slide portion in a first predetermined contact position relative to one of said contacts, said slide portion being reciprocatable to a second contact position relative to the other of said contacts, a locking member on said slide portion near the upper edge thereof to lock said slide portion when said tool is in non-working position, an oscillatable lever providing lock means having a horizontal pivot on the top of said housing guiding said lock means into engagement with said locking member when said slide portion is in one of said contact positions, and an actuator member integral with said oscillatable lever and having an actuatingly engageable portion easily operated by a hand grasping said tool; whereby an operator may grasp said tool and move said actuator member to disengage said lock means from said locking member, and then by said trigger, reciprocate said slide portion into said second contact position.

2. A lock control as defined in claim 1, wherein said actuatingly engageable portion includes a thumb-engageable piece.

3. A lock control as defined in claim 1, wherein said actuatingly engageable portion includes a lever extending downwardly back of said pivot generally parallel to said housing and in position to be squeezed toward said housing by a hand grasping said tool.

4. A lock control as defined in claim 1, wherein said locking member is an upwardly opening recess in the top of said slide portion, and said lock means is a downwardly extending projection on the free end of said oscillatable lever.

* * * * *